US009706278B2

(12) United States Patent
Fujioka

(10) Patent No.: US 9,706,278 B2
(45) Date of Patent: Jul. 11, 2017

(54) WIRELESS MODULAR SPEAKER

(71) Applicant: Fuhu, Inc., El Segundo, CA (US)

(72) Inventor: Robb Fujioka, Manhattan Beach, CA (US)

(73) Assignee: Mattel, Inc., El Segundo, CA (US)

( * ) Notice: Subject to any disclaimer, the term of this patent is extended or adjusted under 35 U.S.C. 154(b) by 30 days.

(21) Appl. No.: 14/684,140

(22) Filed: Apr. 10, 2015

(65) Prior Publication Data

US 2015/0296282 A1 Oct. 15, 2015

Related U.S. Application Data

(60) Provisional application No. 61/978,125, filed on Apr. 10, 2014.

(51) Int. Cl.
*H04R 1/02* (2006.01)

(52) U.S. Cl.
CPC ..... *H04R 1/02* (2013.01); *H04R 2420/07* (2013.01); *H04R 2430/01* (2013.01)

(58) Field of Classification Search
None
See application file for complete search history.

(56) References Cited

U.S. PATENT DOCUMENTS 5,979,591 A * 11/1999 Harrison ..... H04R 1/02 181/151
2007/0160225 A1* 7/2007 Seydoux ..... H04W 8/005 381/79
2012/0235636 A1* 9/2012 Partovi ..... H02J 7/025 320/108
2013/0177186 A1* 7/2013 Schul ..... H04R 5/00 381/300
2014/0016803 A1* 1/2014 Puskarich ..... H04R 1/1041 381/309
2014/0050345 A1* 2/2014 Hilderman ..... H04R 1/026 381/332

* cited by examiner

*Primary Examiner* — Curtis Kuntz
*Assistant Examiner* — Kenny Truong
(74) *Attorney, Agent, or Firm* — Kolisch Hartwell, P.C.

(57) ABSTRACT

A wireless modular speaker is disclosed. According to one embodiment, the apparatus has an enclosure having a top plate, a bottom plate, a front face, a rear face, a first side face, and a second side face, where at least a portion of the enclosure has a cover. The apparatus also has a mounting hole, a gripping mechanism within the mounting hole configured to hold the enclosure in a fixed position, one or more loudspeakers, a battery to supply power to the one or more loudspeakers, a wireless module to connect the apparatus and another device and a sensor mechanism that detects the presence of other speakers near the apparatus.

34 Claims, 5 Drawing Sheets

WIRELESS MODULAR SPEAKER

CROSS-REFERENCE TO RELATED APPLICATIONS

The present application claims priority to U.S. Provisional Patent Application No. 61/978,125, filed on Apr. 10, 2014, entitled "Wireless Modular Speaker", which is herein incorporated by reference.

FIELD

The present disclosure generally relates to loudspeakers, and more particularly to an apparatus and a method for a wireless modular speaker.

BACKGROUND

Loudspeakers used in audio systems are often electrodynamic speakers. Electrodynamic speakers typically have a magnetic motor which moves a cone-shaped diaphragm, thereby creating pressure waves in the surround air, and thus causing sound. The cone-shaped diaphragm is situated within a frame, or a basket, with a wide end of the cone coupled to the frame by way of a flexible membrane, called a suspension, or a surround. The flexible membrane axially centers the cone-shaped diaphragm within the frame, while allowing the cone-shaped diaphragm to move back and forth at audio frequencies. A narrow end of the cone-shaped diaphragm is coupled to the frame by another flexible membrane, called a spider, which also helps to axially center the moving diaphragm.

The motor generally has a voice coil, which usually is behind the narrow end of the cone-shaped diaphragm, and a magnetic circuit adjacent to and/or partially surrounding the voice coil. In operation, electrical audio signals from an amplifier, or other suitable source, are applied to the voice coil, producing a varying electromagnetic field, which interacts with a magnetic field of the magnetic circuit. Interaction between the magnetic fields causes the voice coil to move and, in turn, causes the cone-shaped diaphragm to move in and out relative to the frame. The motion of the diaphragm is why the diaphragm and voice coil are often referred to as a piston, or a driver. The moving diaphragm and voice coil causes pressure waves in the air around the speaker, thereby producing audible sound. Speakers generally are mounted within enclosures to prevent sounds waves emitted from the rear of the diaphragm from interfering with sound waves emitted from the front of the diaphragm.

Speakers typically are divided into three categories: woofer, midrange, and tweeter. A woofer produces low frequency sound ranging from about 20 Hz to 3000 Hz. A midrange speaker produces a broad spectrum of sound, typically ranging between about 1000 Hz and 10 kHz. A tweeter speaker produces high frequency sound ranging between about 4 kHz and 20 kHz. Home audio systems often have a woofer, a midrange, and a tweeter housed within a single enclosure, as in the case of free-standing or floor speaker configurations. Where space is a consideration, the functions of the woofer and midrange may be combined into a single speaker, as in the case of bookshelf-sized speaker configurations.

A drawback to conventional speakers used with home audio systems is a lack of portability. Speaker systems that are housed within enclosures typically are heavy and often bulky, and thus are not amenable to being moved from room to room. Further, speakers that operate with computers typically are cumbersome and have various cables attached, making portability inconvenient. Another drawback is that conventional speakers have fixed frequency ranges. Thus, for example, a woofer speaker generally cannot adjust the output frequency range to accommodate an audio system lacking a midrange speaker. The limitation of frequency ranges often requires at least three or more speakers to cover the audible frequency range. Still another drawback is that conventional home audio systems are not modular, and thus the various component speakers are not interchangeable, and generally are not suited for rearrangement by an end-user of the system. Conventional audio systems generally are assembled into configurations that are fixed by the manufacturer. For example, a conventional two-way audio system with a midrange speaker and a tweeter speaker both housed within an enclosure typically cannot accommodate a woofer speaker unless the user provides an entirely new enclosure suitable for housing all three speakers.

SUMMARY

A wireless modular speaker is disclosed. According to one embodiment, the apparatus has an enclosure having a top plate, a bottom plate, a front face, a rear face, a first side face, and a second side face, where at least a portion of the enclosure has a cover. The apparatus also has a mounting hole, a gripping mechanism within the mounting hole configured to hold the enclosure in a fixed position, one or more loudspeakers, a battery to supply power to the one or more loudspeakers, a wireless module to connect the apparatus and another device and a sensor mechanism that detects the presence of other speakers near the apparatus.

The above and other preferred features, including various novel details of implementation and combination of elements, will now be more particularly described with reference to the accompanying drawings and pointed out in the claims. It will be understood that the particular methods and apparatuses are shown by way of illustration only and not as limitations. As will be understood by those skilled in the art, the principles and features explained herein may be employed in various and numerous embodiments.

BRIEF DESCRIPTION OF THE DRAWINGS

The accompanying drawings, which are included as part of the present specification, illustrate the various embodiments of the present disclosed system and method and together with the general description given above and the detailed description of the preferred embodiment given below serve to explain and teach the principles of the present disclosure.

Figure 1A:
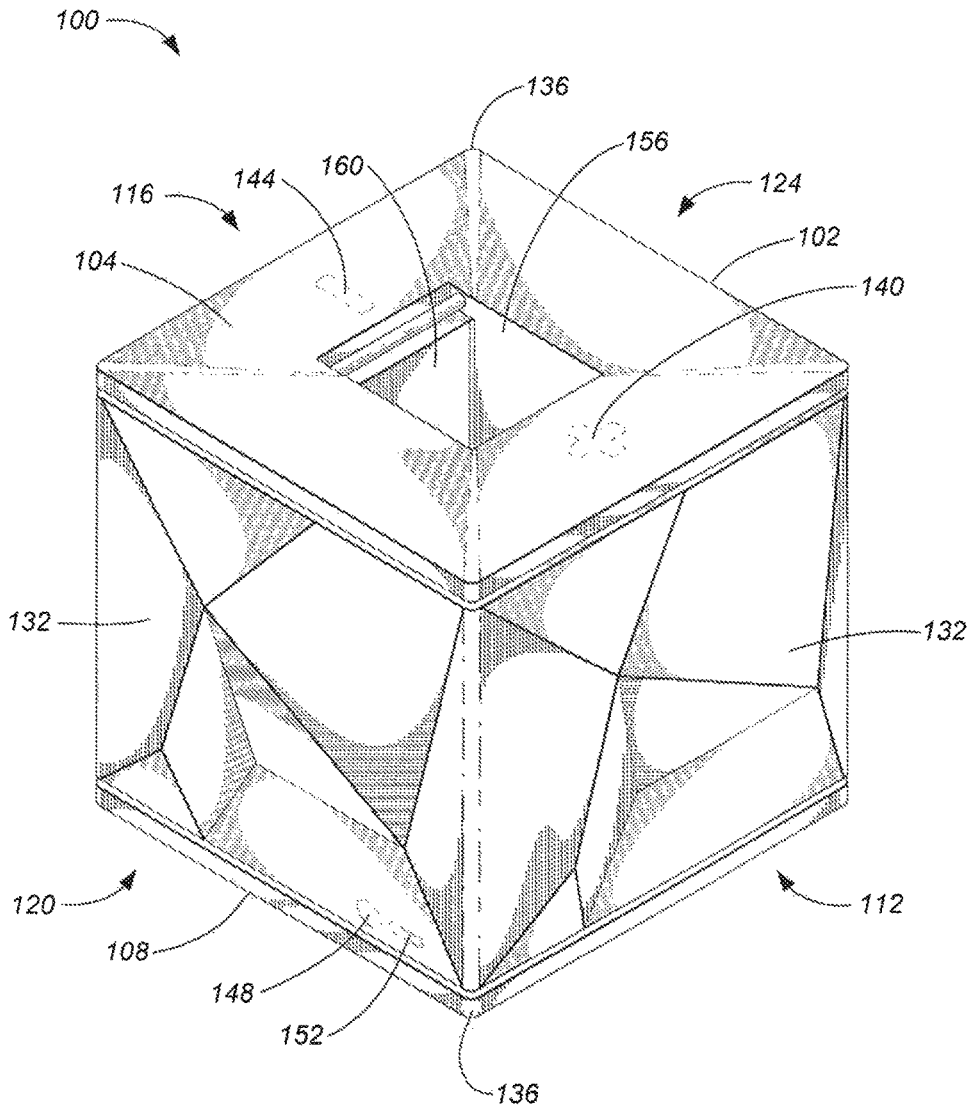
FIG. 1A illustrates an upper perspective view of an exemplary embodiment of a wireless modular speaker, according to one embodiment.

It should be noted that the figures are not necessarily drawn to scale and that elements of structures or functions are generally represented by reference numerals for illustrative purposes throughout the figures. It also should be noted that the figures are only intended to facilitate the description of the various embodiments described herein. The figures do not describe every aspect of the teachings described herein and do not limit the scope of the claims.

DETAILED DESCRIPTION

A wireless modular speaker is disclosed. According to one embodiment, the apparatus has an enclosure having a top plate, a bottom plate, a front face, a rear face, a first side face, and a second side face, where at least a portion of the enclosure has a cover. The apparatus also has a mounting hole, a gripping mechanism within the mounting hole configured to hold the enclosure in a fixed position, one or more loudspeakers, a battery to supply power to the one or more loudspeakers, a wireless module to connect the apparatus and another device and a sensor mechanism that detects the presence of other speakers near the apparatus.

In the following description, for purposes of clarity and conciseness of the description, not all of the numerous components shown in the schematic are described. The numerous components are shown in the drawings to provide a person of ordinary skill in the art a thorough enabling disclosure of the present system and method. The operation of many of the components would be understood to one skilled in the art.

Each of the additional features and teachings disclosed herein can be utilized separately or in conjunction with other features and teachings to provide a detachable frame for a mobile computer. Representative examples utilizing many of these additional features and teachings, both separately and in combination, are described in further detail with reference to the attached drawings. This detailed description is merely intended to teach a person of skill in the art further details for practicing preferred aspects of the present teachings and is not intended to limit the scope of the present disclosure. Therefore, combinations of features disclosed in the following detailed description may not be necessary to practice the teachings in the broadest sense and are instead taught merely to describe particularly representative examples of the present teachings.

Moreover, various features of the representative examples and the dependent claims may be combined in ways that are not specifically and explicitly enumerated in order to provide additional useful embodiments of the present teachings. In addition, it is expressly noted that all features disclosed in the description and/or the claims are intended to be disclosed separately and independently from each other for the purpose of original disclosure, as well as for the purpose of restricting the claimed subject matter independent of the compositions of the features in the embodiments and/or the claims. It is also expressly noted that all value ranges or indications of groups of entities disclose every possible intermediate value or intermediate entity for the purpose of original disclosure, as well as for the purpose of restricting the claimed subject matter. It is also expressly noted that the dimensions and the shapes of the components shown in the figures are designed to help understand how the present teachings are practiced but are not intended to limit the dimensions and the shapes shown in the examples.

Figure 1B:
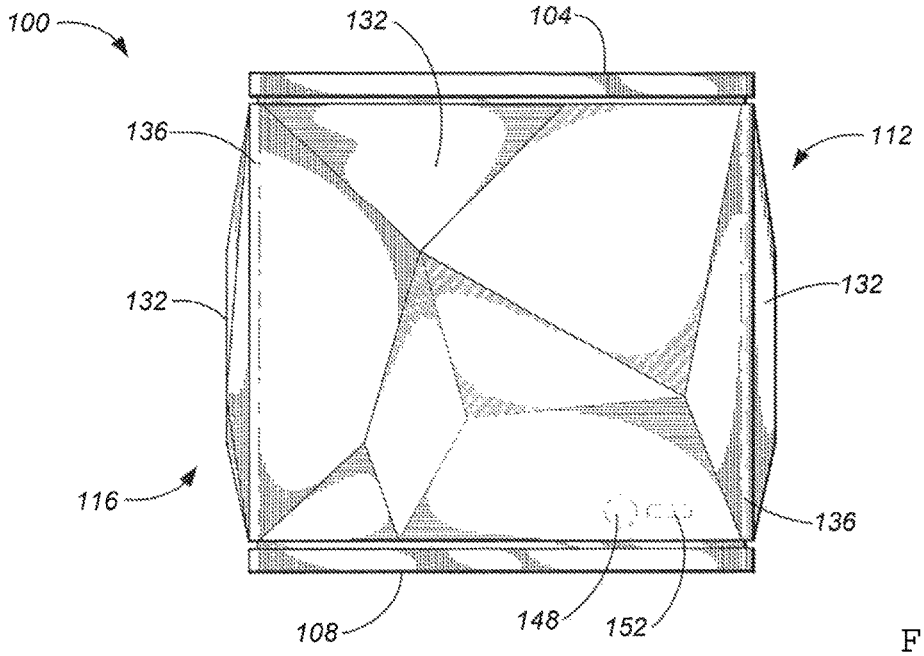
FIG. 1B illustrates a side plan view of the exemplary embodiment of the wireless modular speaker illustrated in FIG. 1A, according to one embodiment.
Figure 1C:
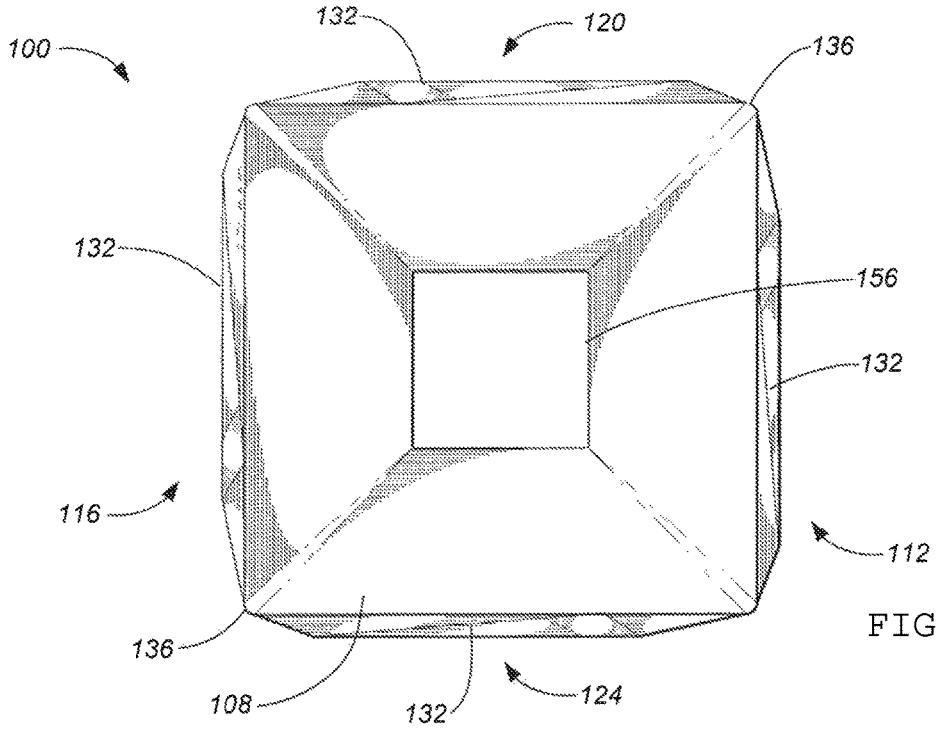
FIG. 1C illustrates a bottom plan view of the exemplary embodiment of the wireless modular speaker illustrated in FIG. 1A, according to one embodiment.

FIGS. 1A-1C illustrate an upper perspective view, a side plan view and a bottom plan view of an exemplary wireless modular speaker 100, according to one embodiment. The wireless modular speaker 100 has a parallelepiped enclosure 102. The enclosure 102 has a top plate 104, a bottom plate 108, a front face 112, a rear face 116, a first side face 120, and a second side face 124. As illustrated in FIGS. 1A-1C, all sides of the enclosure 102 are substantially square, and thus the enclosure 102 generally is a cube. In other embodiments, however, the enclosure 102 may not be square. Various configurations of the enclosure 102 other than as described herein will be apparent to those skilled in the art without deviation from the present invention.

Figure 1D:
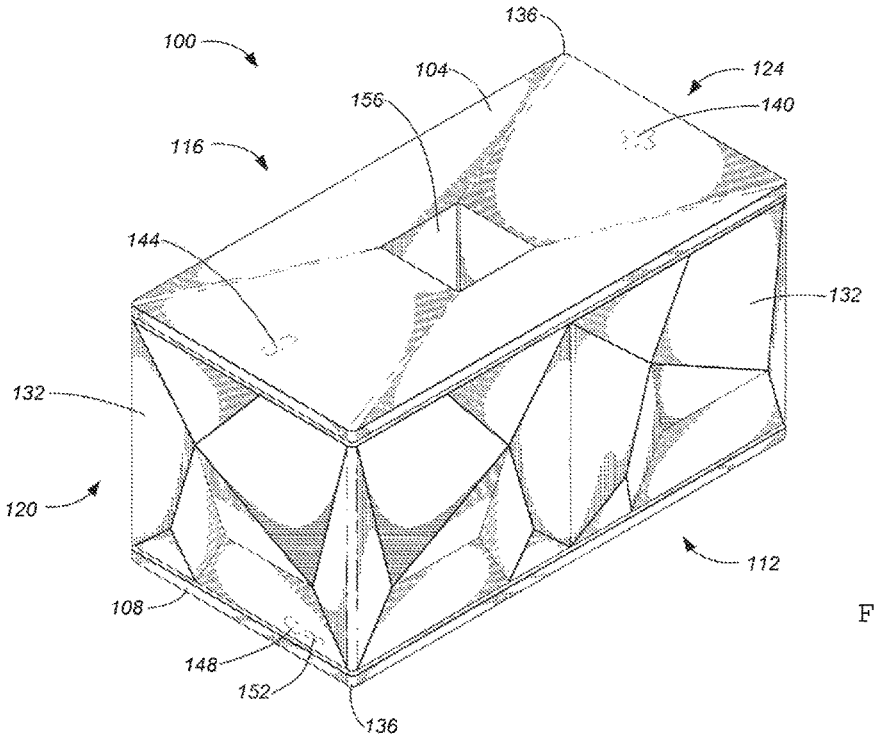
FIG. 1D illustrates an upper perspective view of another exemplary embodiment of a wireless modular speaker, according to one embodiment.

For example, in another embodiment as illustrated in FIG. 1D, the top and bottom plates 104, 108 and the front and rear faces 112, 116 are rectangles while the first and second sides 120, 124 are squares, such that the wireless modular speaker 100 has a width dimension which is greater than a depth dimension and a height dimension of the wireless modular speaker 100. It will be apparent to those skilled in the art that the relative size of the wireless modular speaker 100 is dependent upon the size and number of loudspeakers that are to be mounted within the enclosure 102.

For example, an embodiment of the enclosure 102 designed for one or more woofer speakers will be relatively larger in size than an embodiment of the enclosure 102 intended to support one or more midrange speakers. Similarly, the embodiment of the enclosure 102 designed for midrange speakers will be larger in size than an embodiment of the enclosure 102 which in intended for one or more tweeter speakers. It is envisioned that various speaker systems may be assembled by combining suitable sizes of the wireless modular speaker 100. For example, an embodiment of a three-way speaker system may contain an embodiment of the wireless modular speaker 100 designed for a woofer speaker, an embodiment of the wireless modular speaker 100 designed for a midrange speaker, and an embodiment of the wireless modular speaker 100 designed for a tweeter speaker. It should be understood, however, that although the sizes of the various embodiments of the enclosure 102 may differ, the height, width, and depth dimensions of the wireless modular speaker 100 are intended to be consistent with the embodiments illustrated in FIGS. 1A-1D.

Referring back to FIG. 1A, each of the faces 112, 116, 120, and 124 of the enclosure 102 includes a cover 132 which operates as a protective cover for a loudspeaker mounted within the enclosure 102. Preferably, the cover 132 is made of a generally porous, soft material which offers a minimal degree of sound absorption. Adjacent cover 132 is joined by rounded edges 136 which give the enclosure 102 a smooth finished appearance. In the illustrated embodiment of FIG. 1A, the cover 132 includes angular topological features. In other embodiments, however, various other topological features may be used with the cover 132 without detracting from the scope of the present invention. In still other embodiments, the cover 132 may operate as a skin which may be interchanged with various other skins by an end-user so as to alter the appearance of the wireless modular speaker 100.

It will be recognized that although each of the faces 112, 116, 120, and 124 of the enclosure 102 includes the cover 132, there need not be a loudspeaker mounted within all of the faces of the enclosure 102. In one embodiment, a loudspeaker is mounted to the front face 112 under the cover 132 while the faces 116, 120, and 124 solely have the cover 132. In another embodiment, for example, loudspeakers may be mounted to only the first and the second side faces 120, 124, and the front face 112 and the rear face 116 may have the aesthetic cover 132 without loudspeakers. In other embodiments, more than one loudspeaker may be mounted to one or more of the faces 112, 116, 120, and 124. It should be understood that any number of loudspeakers may be mounted behind the faces 112, 116, 120, and 124 of the enclosure 102 without deviating from the scope of the invention.

As shown in FIG. 1A, the top plate 104 has a volume increase control 140 and a volume decrease control 144. In the illustrated embodiment of the wireless modular speaker 100, the volume controls 140, 144 allow an end-user to operate the controls by placing a finger on the control. In one embodiment, the volume controls 140, 144 may detect the proximity of the end-user's finger and thus operate without the end-user tapping, swiping, or otherwise touching the controls. In another embodiment, the controls 140, 144 allow the end-user to physically contact the control to change the output volume of the loudspeaker. It is envisioned that the enclosure 102 contains hardware and firmware suitable (e.g. pressure sensor) for detecting the presence of the end-user's finger or other object at the controls 140, 144 and respectively increasing or decreasing the output volume of the one or more loudspeakers. In other embodiments, the volume controls 140, 144 are buttons that the end-user depresses to increase or decrease the output volume of the one or more loudspeakers.

As illustrated in FIGS. 1A-1B, the first side face 120 has a power button 148 and a connection button 152. The power button 148 enables the end-user to turn the wireless modular speaker 100 on and off, as desired. Once the power to the speaker is turned on, the connection button 152 enables the end-user to link the wireless modular speaker 100 with other similar speakers nearby. For example, in case a first and a second of the wireless modular speaker 100 operating together as a two-way sound system (e.g., a woofer speaker and a tweeter speaker), the end-user may use the power button 148 to turn on a third wireless modular speaker 100 and then use the connection button 152 to link the third speaker with the first and the second speakers so as to form a three-way sound system.

As with the volume controls 140, 144, discussed above, the power button 148 and the connection button 152 can detect the proximity of the end-user's finger. In one embodiment, the buttons 148, 152 detect the presence of the end-user's finger without the end-user touching the button. In another embodiment, the buttons 148, 152 may be tapped or swiped by the end-user's finger. In still another embodiment, the buttons 148, 152 may be physically depressed by the end-user. Accordingly, the cover 132 may include openings corresponding to the locations of the buttons 148, 152, or may include any of a variety of descriptive symbols and text to indicate the locations of the buttons 148, 152 to the end-user in lieu of physical openings. It is envisioned that where the cover 132 operates as a decorative skin for the wireless modular speaker, that various embodiments of the cover 132 include descriptive symbols, text, or openings corresponding to standardized locations of the buttons 148, 152.

Referring again to FIGS. 1A and 1C the wireless modular speaker 100 has a mounting hole 156 which passes from the top plate 104 through the speaker to the bottom plate 108. The mounting hole 156 preferably has a size and a shape to receive a vertical member of a speaker stand (not shown), or speaker tower, which operates in conjunction with the wireless modular speaker 100. In the illustrated embodiment of FIG. 1A, a gripping mechanism 160 is located within the mounting hole 156. The gripping mechanism 160 holds the wireless modular speaker 100 in a fixed position once mounted on the vertical member of the speaker stand. In one embodiment, the vertical member may contain a ferromagnetic material and the gripping mechanism 160 may be a magnetic fastener that uses magnetic attraction to hold the wireless modular speaker 100 in a fixed position on the speaker stand. In another embodiment, the gripping mechanism 160 may be configured to grip the vertical member by way of friction so as to hold the wireless modular speaker 100 fixed in position on the vertical member. In other embodiments, however, the mounting hole 156 and the gripping mechanism 160 may be omitted from the wireless modular speaker 100 and any of a variety of suitable fasteners may be utilized to mount the wireless modular speaker 100 on the vertical member. In another embodiment, the gripping mechanism 160 can also be a flap that opens or closes. In one embodiment, the gripping mechanism 160 can act as a switch that determines when it should be used with another speaker or operate independently. For example, when the speaker is mounted on a speaker stand and the flap is opened, the speaker searches for other nearby speakers to which it can connect.

Figure 2:
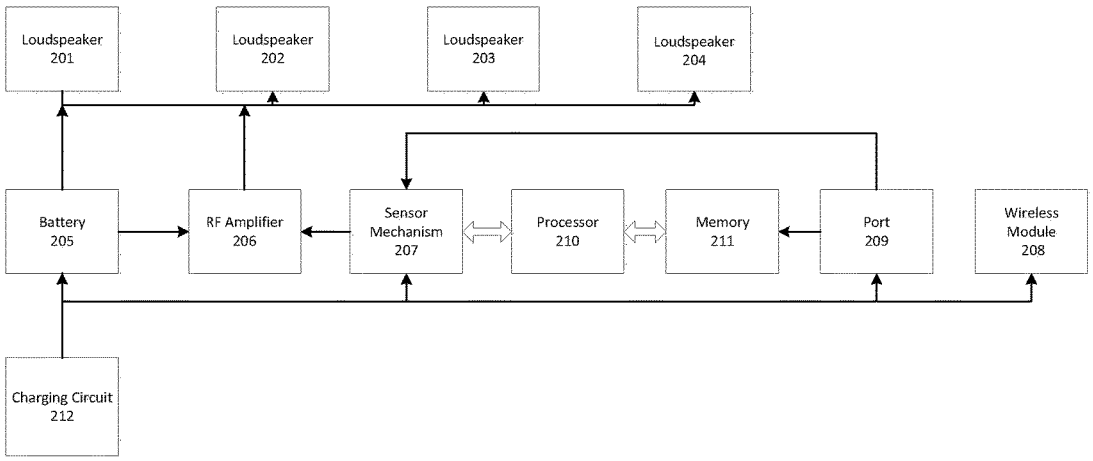
FIG. 2 illustrates a block diagram representation of the circuitry of an exemplary wireless modular speaker, according to one embodiment.

FIG. 2 illustrates a block diagram representation of the internal circuitry 200 of the exemplary wireless modular speaker 100, according to one embodiment. The internal circuitry 200 of the wireless modular speaker 100 has four loudspeakers 201, 202, 203 and 204, a battery 205, an RF amplifier 206, a sensor mechanism 207, a wireless module 208, a processor 210, memory 211, a charging circuit 212 and optionally, a port 209. The loudspeakers 201, 202, 203 and 204 are mounted within the four faces 112, 116, 120, and 124 of the wireless modular speaker 100, underneath the cover 132.

The battery 205 supplies power to the various components of the wireless modular speaker 100 to generate sound by way of the RF amplifier 206 and the loudspeakers 201, 202, 203 and 204, in absence of an external power source. In one embodiment, the battery 205 is charged through a charging circuit 212 connected to an AC power source. In another embodiment, a speaker stand that is used with the wireless modular speaker 100 includes electrical circuitry suitable for inductively charging (e.g. wirelessly charging) a battery within the wireless modular speaker 100. Preferably, the bottom plate 108 of the wireless modular speaker 100 and corresponding portions of the speaker stand both contain circuitry for inductive coupling there between. Upon mounting the wireless modular speaker 100 on the speaker stand and then coupling the speaker stand with an AC power source, such as a wall outlet, the battery 205 is inductively charged, even while the wireless modular speaker 100 is being used to produce audio output. Alternatively, in another embodiment the inductive circuitry may be advantageously positioned within the mounting hole 156 of the wireless modular speaker 100. It will be recognized by those skilled in the art that a wide variety of implementations of inductive circuitry may be used with the wireless modular speaker 100 and the associated speaker stand without deviating from the spirit and scope of the present invention.

The sensor mechanism 207 of the wireless modular speaker 100 detects the presence of other wireless modular speakers in the vicinity. In case, the presence of other modular speakers is detected, the sensor mechanism 207 sends a signal to the RF amplifier 206 to adjust the output audio frequencies of the loudspeakers 201, 202, 203 and 204 accordingly, so as to reduce overlapping frequencies. The sensor mechanism 207 also detects the presence of an end-user's finger at the controls 140, 144 of the wireless modular speaker 100 and respectively increases or decreases the output volume of the loudspeakers 201, 202, 203 and 204. In other embodiments, the volume controls 140, 144 may have buttons that the end-user depresses to increase or decrease the output volume of the loudspeakers 201, 202, 203 and 204.

The wireless module 208 in conjunction with the connection button 152 enables the end-user to link the wireless modular speaker 100 with other speakers nearby, by establishing wireless connections with other wireless modular speakers. In one embodiment, the wireless module 208 supports Bluetooth protocols. In another embodiment, the wireless module 208 supports Bluetooth SMART. In another embodiment, the wireless module 208 supports Near Field Communication (NFC). In still another embodiment, the wireless module 208 has wireless network interface (WiFi) controllers that are compliant with Institute of Electrical and Electronics Engineers' (IEEE) 802.11 a/b/g/n standard.

In some embodiments, the wireless modular speaker 100 can connect to a mobile device using Bluetooth or WiFi using the wireless module 208. Wireless modular speaker 100 streams music from the mobile device. The mobile device may control the operation of the wireless modular speaker 100. A mobile device could be a smart phone or tablet using the Android, iOS or other operating system.

In another embodiment, if the wireless modular speaker 100 receives a music file from a mobile device in a certain format (e.g. dvf) that is not supported by the operating system (e.g. iOS) of the processor 210, the processor in conjunction with memory 211 converts the received music file to a format (e.g. aiff) that is compatible with the operating system of the processor 210 and play the music file. In yet another embodiment, the wireless modular speaker 100 is enabled with Apple Inc.'s AirDrop service and may include Android, OS X or iOS, In some other embodiments, the processor 210 of the wireless modular speaker 100 runs applications on its operating system to support Internet music streaming using the wireless module 208 without connecting to a mobile device.

In one embodiment, the memory 211 is a machine-readable medium that includes read only memory (ROM); random access memory (RAM); magnetic disk storage media; optical storage media; flash memory devices; Digital VideoDisc (DVD's), EPROMs, EEPROMs, FLASH memory, magnetic or optical cards, or any type of media suitable for storing electronic instructions. For example, digital data packets may be stored and buffered in memory 211 to allow uninterrupted music streaming. Memory 211 may also store album art and graphics for display on an integrated LCD panel.

In some embodiments, the wireless modular speaker 100 may contain at least one port 209 that supports a physical connection, such as plug, whereby multiple speakers may be physically linked together. In one embodiment, the port 209 can be used for charging the battery through the charging circuit 212. In another embodiment, the port 209 can be used as an audio input. The port 209 could be USB, HDMI, Optical, AC/DC power and the like. In some embodiments, the wireless modular speaker 100 has a LCD panel mounted on the cover 132. The LCD panel can be used to control the operations of the wireless modular speaker 100 including music streaming, volume control, device pairing, and speaker connectivity. Further, it is envisioned that a multiplicity of the wireless modular speakers 100 may detect the presence of one another using their internal sensor mechanism 207 and adjust the output audio frequencies of their internal RF amplifiers 206 and the loudspeakers 201, 202, 203 and 204 accordingly.

For example, in one embodiment, a speaker network has two wireless modular speakers 100 (e.g., a first speaker and a second speaker) connected to each other via their respective wireless modules 208. In this exemplary embodiment, it is envisioned that a first wireless modular speaker in the speaker network produces a broad spectrum of sound ranging from 1000 Hz to 10 kHz. It is also envisioned that a second speaker in the speaker network produces sound ranging from 20 Hz to 1000 Hz. If, a third wireless modular speaker 100 with an output frequency from 4 kHz to 20 kHz comes within range of the first and the second speakers of the speaker network, the third wireless modular speaker is linked to the first and the second wireless modular speakers of the speaker network by way of the wireless module 208 (or the connection button 152). Once connected, the three speakers adjust the audio output of their respective RF amplifiers 206 and the loudspeakers 201, 202, 203 and 204 so as to form a three-way sound system without producing substantially overlapping audio frequencies.

For example, once the connection between the three speakers is established, the first wireless modular speaker adjusts its output frequency from original frequency range of 1000 Hz to 10 KHz to a modified frequency range of 1000 Hz to 5 kHz. Similarly, the second wireless modular speaker adjusts its output frequency from original frequency range of 20 Hz to 1000 Hz to a modified frequency range of 20 Hz to 900 Hz and the third wireless modular speaker adjusts its output frequency from a frequency range of 4 kHz to 20 kHz to a modified frequency range of 6 kHz to 20 kHz. Therefore, substantially reducing overlapping audio frequencies when interconnected.

A wireless modular speaker 100 may detect and connect to another modular speaker that is within range of its wireless module 208. For example, if using Bluetooth, the wireless modular speakers 100 automatically connect when they are within approximately 30 feet of each other. If using NFC, the modular speakers 100 automatically connect when they are within approximately 4 inches of each other. If using WiFi, the modular speakers 100 automatically connect when they are within approximately 150 feet of each other or based upon the detected signal strength of the WiFi connection.

Moreover, it is envisioned that if the third speaker is powered off, the first and the second wireless modular speakers 100 detect the absence of the third speaker using their internal sensor mechanism 207 and then each adjusts the sound output of their RF amplifiers 206 and the loudspeakers 201, 202, 203 and 204 to compensate for the absence of the third wireless modular speaker 100. It will be appreciated that the ability to detect other wireless modular speakers 100 and cooperatively adjust audio frequencies enables the end-user to quickly and conveniently create customized sound systems, as desired, by adding and removing various embodiments of the wireless modular speaker 100.

Figure 3:
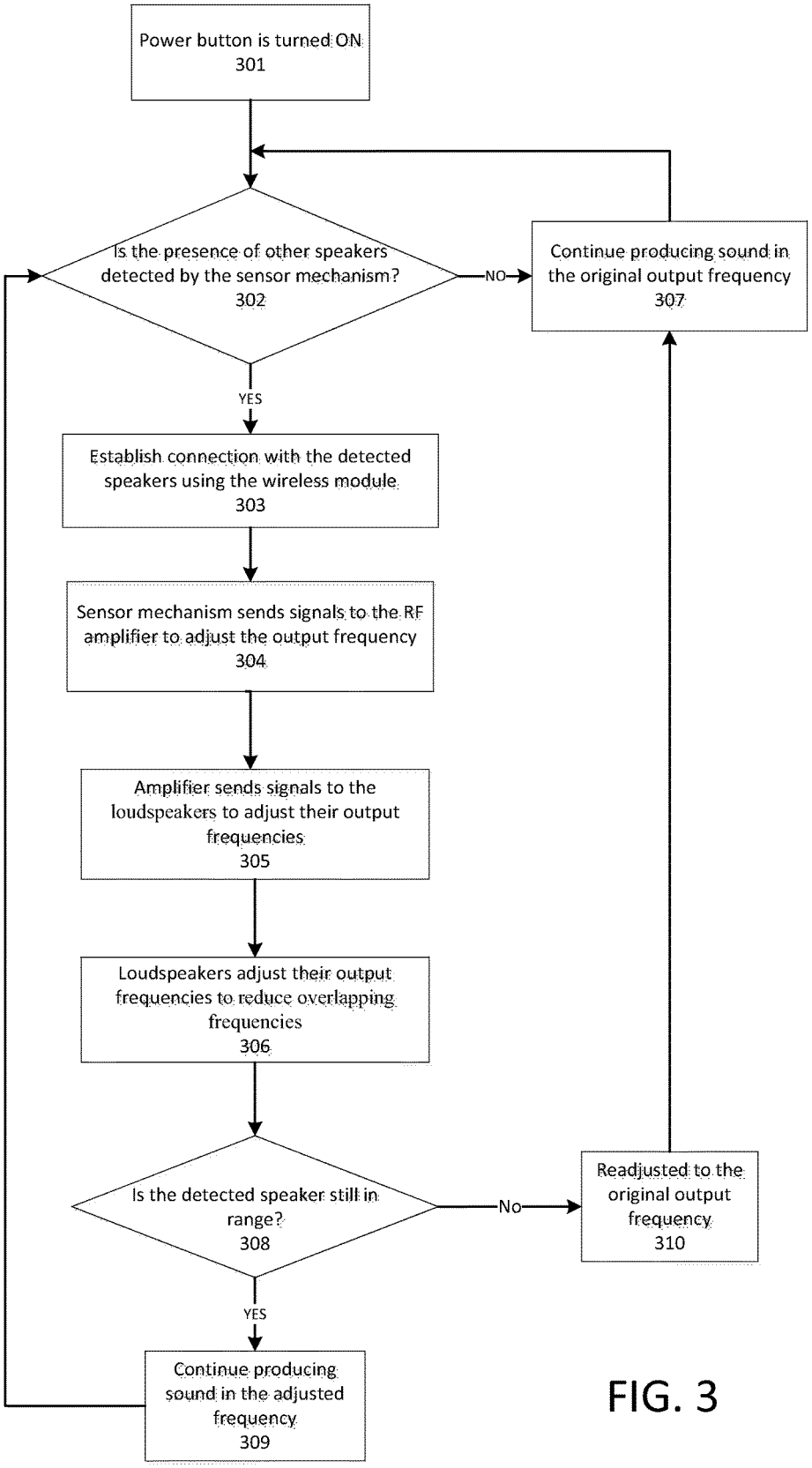
FIG. 3 illustrates a method for detecting the presence of other speakers and adjusting the output audio frequencies, according to one embodiment.

FIG. 3 illustrates a method for detecting the presence of other speakers and adjusting the output audio frequency, according to one embodiment.

The method of FIG. 3 starts at 301, as an end user turns on a first wireless modular speaker 100 by pressing the power button 148 to provide power to the different components of the first wireless modular speaker 100. In this exemplary embodiment, it is envisioned that the first wireless modular speaker 100 produces a broad spectrum of sound frequency ranging from about 1000 Hz to 10 KHz. It is also envisioned that the first wireless modular speaker 100 is connected to a mobile device using the wireless module 208 (Bluetooth or WiFi) to stream music from the mobile device. Moreover, it is envisioned that a second wireless modular speaker 100 produces frequency sound ranging from about 20 Hz to 3000 Hz.

Next at 302, the processor 210 determines if the presence of any other speaker is in proximity to the first wireless modular speaker is detected by the sensor mechanism 207. The sensor mechanism 207 also detects the frequency range of a speaker. If at 302, the sensor mechanism 207 detects the presence of any other speaker in proximity to the first wireless modular speaker, the process proceeds to 303. At 303, the processor 210 links the first wireless modular speakers 100 to the detected speaker using the wireless module 208. For example, at 302, if the sensor mechanism 207 detects the presence of a second wireless modular speaker 100 by way of the second wireless modular speaker 100 coming within range of the first wireless modular speaker 100, the process proceeds to 303. At 303, the processor 210 links the first wireless modular speaker 100 to the second wireless modular speaker 100 using the wireless module 208.

In some embodiments, the connection button 152 can be used to link two speakers. In some embodiments, each of the first and the second wireless modular speakers 100 may contain at least one port 209 which supports a physical connection, such as plug, to establish physical connection with the other speaker.

At 304, the sensor mechanism 207 of the first wireless modular speaker 100 sends a signal to the RF amplifier 206 to adjust its output frequency. At 305, the RF amplifier 206 of the first wireless modular speaker 100 sends signals to the loudspeakers 201, 202, 203 and 204 to adjust their output frequencies to substantially reduce overlapping frequencies. For example, since the second wireless modular speaker 100 produces sound ranging in frequency from 20 Hz to 3000 Hz, the RF amplifier 206 sends signals to the loudspeakers 201, 202, 203 and 204 of the first wireless modular speaker 100 to adjust their output frequency from original frequency range of 1000 Hz to 10 KHz to a modified frequency range of 3000 Hz to 10 KHz. Next, at 306, the loudspeakers 201, 202, 203 and 204 of the first wireless modular speaker 100 adjust their output frequencies to substantially reduce overlapping frequencies with the second wireless modular speaker 100.

On the other hand, if at 302, the sensor mechanism 207 of the first wireless modular speaker 100 does not detect the presence of any other speakers in proximity to the first wireless modular speaker 100, the process proceeds to 307 and the first wireless modular speaker 100 continues to produce sound in its original frequency range of 1000 Hz to 10 KHz.

At 308, the first wireless modular speaker determines if the second wireless modular speaker 100 is still in the range. If so, the process proceeds to 309 and the first wireless modular speaker 100 continues to produce sound in the adjusted frequency range to reduce overlapping frequencies.

However, if at 308, the first wireless modular speaker determines that the second wireless modular speaker 100 is no longer in range, the process proceeds to 310. At 310, the first wireless modular speaker 100 readjust its output frequency from the adjusted frequency of 3001 Hz to 10 KHz to its original frequency range of 1000 Hz to 10 KHz. The process then returns to 302 via 307 and continues.

In an embodiment, a tablet computer may be utilized in conjunction with one or more of the wireless modular speakers 100 by way of a tablet docking station. In one embodiment, the tablet docking station may be coupled with the one or more wireless modular speakers 100 such that audio sounds generated on the tablet computer are transmitted by way of the wireless modular speakers 100 in lieu of the speakers within the tablet computer. In some embodiments, the docking station may be utilized to inductively charge the battery 205 within the wireless modular speaker 100 while the wireless modular speaker 100 is being used for audio sound production. It will be recognized by those skilled in the art that the wireless modular speaker 100 may be coupled with the docking station either by way of direct cable connections or by way of a wireless connection. Accordingly, in one embodiment of a wireless connection, the tablet docking station and the wireless modular speaker 100 may communicate by way of Bluetooth protocols, including Bluetooth SMART embedded within the wireless module 208 of the internal circuitry 200. In another embodiment, the communication may be by way of NFC. In still another embodiment, the communication may be by way of a WiFi connection. Various methods whereby the docking station may be coupled with one or more wireless modular speakers 100 will be apparent to those of ordinary skill in the art without deviating from the spirit and the scope of the present invention.

In some embodiments, speaker networks may be formed by wirelessly linking together a multiplicity of wireless modular speakers 100. In some embodiments, speaker networks may enable a first end-user of a first wireless modular speaker 100 to share, or transmit, audio data to a second wireless modular speaker 100 such that an end-user of the second wireless modular speaker 100 may listen to audio sounds corresponding to the transmitted audio data. A wide variety of network configurations, including but not limited to speaker networks, and uses thereof will be apparent to those skilled in the art without deviating from the scope of the present invention.

While some specific embodiments of the present invention have been shown the invention is not to be limited to these embodiments. For example, most functions performed by electronic hardware components may be duplicated by software emulation. Thus, a software program written to accomplish those same functions may emulate the functionality of the hardware components in input-output circuitry. The present invention is to be understood as not limited by the specific embodiments described herein, but only by scope of the appended claims.

What is claimed is:

1. A wireless modular speaker, comprising:

an enclosure comprising a top plate, a bottom plate, a front face, a rear face, a first side face, and a second side face, wherein at least a portion of the enclosure has a cover;

a mounting hole that receives a supportive member of a speaker stand;

a gripping mechanism within the mounting hole configured to hold the enclosure in a fixed position, wherein the supportive member is comprised of a ferromagnetic material and the gripping mechanism comprises a magnetic fastener configured to employ magnetic attraction to hold the wireless modular speaker in the fixed position on the speaker stand;

one or more loudspeakers within the enclosure;

a battery configured to supply power to the one or more loudspeakers;

a sensor mechanism configured to detect the presence of one or more other speakers near the wireless modular speaker; and a wireless module to connect the wireless modular speaker and the detected one or more other speakers.

2. The wireless modular speaker of claim 1, wherein the enclosure is rectangular.

3. The wireless modular speaker of claim 1, wherein the wireless modular speaker is one of a plurality of wireless modular speakers that are wirelessly linked together to form a speaker network.

4. The wireless modular speaker of claim 3, wherein the speaker network enables a first wireless modular speaker to transmit audio data to a second wireless modular speaker such that an end-user of the second wireless modular speaker may listen to the audio sounds corresponding to the transmitted audio data.

5. The wireless modular speaker of claim 1, wherein the enclosure has a width dimension, a depth dimension, and a height dimension that are substantially equal such that the wireless modular speaker is substantially a cube.

6. The wireless modular speaker of claim 1 further comprises: an amplifier, a processor and memory.

7. The wireless modular speaker of claim 6, wherein the sensor mechanism is configured to adjust output frequencies of the amplifier and the one or more loudspeakers to reduce overlapping frequencies with the one or more other speakers.

8. The wireless modular speaker of claim 1, wherein the one or more loudspeakers comprise one or more woofer speakers, one or more midrange speakers, or one or more tweeter speakers.

9. The wireless modular speaker of claim 1, wherein the one or more loudspeakers are a combination of one or more of woofer speakers, midrange speakers, or tweeter speakers.

10. The wireless modular speaker of claim 1, wherein various speaker systems may be assembled by combining suitable sizes of the wireless modular speaker.

11. The wireless modular speaker of claim 1, further comprising:

covers for the one or more loudspeakers mounted within the enclosure, and rounded edges joining the covers.

12. The wireless modular speaker of claim 11, wherein the covers are comprised of a porous and pliable material.

13. The wireless modular speaker of claim 11, wherein the covers include angular topological features.

14. The wireless modular speaker of claim 13, wherein the covers are a skin which is interchangeable with other skins to alter the appearance of the wireless modular speaker.

15. The wireless modular speaker of claim 1, wherein the top plate comprises a volume increase control and a volume decrease control.

16. The wireless modular speaker of claim 15, wherein the sensor mechanism is configured to detect the proximity of an object at the volume increase control and the volume decrease control, and respectively increase or decrease the output volume of the one or more loudspeakers.

17. The wireless modular speaker of claim 15, wherein the volume increase control and the volume decrease control comprise buttons that are depressed in order to respectively increase or decrease the output volume of the one or more loudspeakers.

18. The wireless modular speaker of claim 1, wherein the volume increase control and the volume decrease control are configured such that an end-user operates the controls by placing a finger on the control.

19. The wireless modular speaker of claim 1, wherein the volume increase control and the volume decrease control are configured to detect the proximity of an end-user's finger.

20. The wireless modular speaker of claim 1, wherein the first side face comprises a power button to turn the wireless modular speaker on and off.

21. The wireless modular speaker of claim 20, wherein the first side face comprises a connection button to link the wireless modular speaker with other speakers near the wireless modular speaker.

22. The wireless modular speaker of claim 1, wherein the gripping mechanism is configured to grip the supportive member so as to hold the wireless modular speaker in the fixed position on the vertical member using friction.

23. The wireless modular speaker of claim 1, wherein the bottom plate of the wireless modular speaker comprises inductive circuitry suitable for inductively charging the battery when the wireless modular speaker is inductively coupled to an inductive charger.

24. The wireless modular speaker of claim 23, wherein inductively charging the battery and operating the wireless modular speaker to produce audible sounds occurs simultaneously.

25. The wireless modular speaker of claim 1, wherein the wireless modular speakers is coupled to a tablet computer by way of a tablet docking station.

26. The wireless modular speaker of claim 25, wherein the tablet docking station is coupled with one or more wireless modular speakers.

27. The wireless modular speaker of claim 25, wherein the docking station inductively charges the battery in the wireless modular speaker.

28. The wireless modular speaker of claim 25, wherein the wireless modular speaker is coupled to the tablet docking station by way of a wireless connection.

29. The wireless modular speaker of claim 25, wherein the wireless modular speaker is coupled to the docking station using a cable.

30. A methods comprising:

determining the presence of one or more other speakers near a wireless modular speaker;

establishing a wireless connection between the wireless modular speaker and the one or more other speakers;

sending signals to an amplifier and one or more loudspeakers of the wireless modular speaker; and adjusting an output frequency range of the one or more loudspeakers from an original output frequency range to an adjusted output frequency range in response to the sent signals;

determining whether the wireless modular speaker is connected to the one or more other speakers;

producing sound having the adjusted output frequency range when the wireless modular speaker is connected to the one or more other speakers; and producing sound having the original output frequency range when the wireless modular speaker is disconnected from the one or more other speakers.

31. The wireless modular speaker of claim 1, wherein the mounting hole passes from the top plate to the bottom plate.

32. The method of claim 30, wherein the original output frequency range of the one or more loudspeakers of the wireless modular speaker is 1000 Hz to 10 KHz.

33. The method of claim 32, wherein the one or more other speakers produces sound ranging from 20 Hz to 3000 Hz.

34. The method of claim 33, wherein the adjusted output frequency range of the one or more loudspeakers of the wireless modular speaker is 3001 Hz to 10 KHz.

* * * * *